US005450179A

United States Patent [19]

Kasiske et al.

[11] Patent Number: 5,450,179

[45] Date of Patent: Sep. 12, 1995

[54] ACTIVE CHARGING TO PREVENT IMAGE DISRUPTION

[75] Inventors: W. Charles Kasiske, Rochester; David M. Rakov, Irondequoit, both of N.Y.

[73] Assignee: Eastman Kodak Company, Rochester, N.Y.

[21] Appl. No.: 203,164

[22] Filed: Feb. 28, 1994

[51] Int. Cl.[6] ..... G03G 15/16

[52] U.S. Cl. ..... 355/274; 355/273; 355/275

[58] Field of Search ..... 355/271, 273, 274, 275, 355/276, 200, 210, 282, 284

[56] References Cited

U.S. PATENT DOCUMENTS

| | | | |
|---|---|---|---|
| 3,508,824 | 4/1970 | Leinbach et al. | 355/315 |
| 3,575,502 | 4/1971 | Eppe | 355/274 |
| 3,615,414 | 10/1971 | Light | 96/1.6 |
| 3,832,053 | 8/1974 | Goel et al. | 355/274 |
| 3,972,714 | 8/1976 | Weber et al. | 355/220 X |
| 3,976,370 | 8/1976 | Goel et al. | 355/271 X |
| 4,341,457 | 7/1982 | Nakahata et al. | 355/274 |
| 4,862,215 | 8/1989 | Nomura et al. | 355/309 |
| 4,896,192 | 1/1990 | Kinoshita | 355/315 |
| 4,994,861 | 2/1991 | Brandon et al. | 355/274 |
| 5,049,934 | 9/1991 | Saito | 355/219 |
| 5,059,990 | 10/1991 | Abreu et al. | 346/153 |

*Primary Examiner*—Matthew S. Smith
*Attorney, Agent, or Firm*—Lawrence P. Kessler

[57] ABSTRACT

An electrostatographic reproduction apparatus having a dielectric member transported about a path in sequential operative relation with electrographic process stations. The moving dielectric member is uniformly charged, and thereafter the uniform charge on the dielectrid member is selectively altered to form a latent image charge pattern thereon corresponding to information to be reproduced. The latent image charge pattern on the dielectric member is developed with triboelectrically charged pigmented marking particles. A receiver member is transported into operative association with a marking particle developed image on the dielectric member. An electrostatic charge is placed on the receiver member, such charge being of a polarity to induce transfer of a marking particle developed image from the dielectric member to the receiver member. The image bearing receiver member is transported along a path from the dielectric member to a fixing apparatus where a transferred developed marking particle image is fixed to the receiver member. A charger, located adjacent to the mechanism for transporting the image bearing receiver member, is for the purpose of placing a charge on a receiver member transported along the path from the dielectric member to the fixing apparatus, such charge being of the opposite polarity as the charge applied to the receiver member to effect transfer of the developed marking particle image to such receiver member.

5 Claims, 3 Drawing Sheets

ACTIVE CHARGING TO PREVENT IMAGE DISRUPTION

BACKGROUND OF THE INVENTION

1. Technical Field

The present invention relates in general to minimizing disruption of a marking particle image electrographically formed on a receiver member, and more particularly to active charging of a receiver member to substantially prevent disruption of the marking particle image thereon due to ionization of the air gap between the receiver member and a prefuser transport therefor.

2. Background Art

In reproduction apparatus, such as electrostatographic copiers or printers, for example, a uniformly charged dielectric member is exposed in an image-wise pattern to an image of original information to be reproduced. Such exposure of the dielectric member alters the uniform charge in a corresponding image-wise pattern forming a latent image charge pattern thereon. The charge pattern is then developed with pigmented marking particles from a development mechanism. The developed image is thereafter transferred to a receiver member, and fixed to the receiver member to form the desired reproduction of the original information.

In typical electrostatographic reproduction apparatus, transfer of the developed image from the dielectric member to the receiver member is accomplished by applying an electric field across the dielectric member and the receiver member while the two are brought into intimate relationship. The electric field is selected to attract the marking particles of the developed image from the dielectric member and hold the marking particles to the receiver member. When the receiver member is stripped from the dielectric member, the developed image remains with the receiver member. The receiver member is then transported to a downstream location where the marking particles of the developed image are fixed to the receiver member by application of heat and/or pressure for example.

It has been found that in electric field transfer, in order to obtain high transfer efficiency (i.e., to prevent any back transfer of the developed image marking particles from the receiver member back to the dielectric member), the electric field should provide an excess charge on the back side of the receiver member. As depicted in FIG. 2, when the receiver member (designated by the letter R) is delivered to the fixing location by a transport mechanism 136 made of grounded conductive material, charges Ca of opposite sign to the excess charges Cb on the back side Ra of the receiver member R build up on the surface 136*a* of the transport mechanism at the transport mechanism/receiver member interface.

It is now recognized that as the receiver member R moves along the surface 136*a* of the transport mechanism 136, the charges Ca on such surface flow toward the downstream edge 136*b* of the transport mechanism. Due to the fact that the flowing surface charges Ca cannot travel farther than the edge 136*b* of the transport mechanism, the charges collect at such edge. At the same time, due to the surface resistivity of the transported receiver member R, the charges on the back side Ra of the receiver member cannot move freely back along the receiver member in the direction toward the collection of opposite charge at the transport mechanism edge 136*b*. As a result, the transport mechanism surface charges Ca and the receiver member charges Cb separate, and the voltage therebetween increases until electrostatic breakdown (ionization) of the air occurs.

During such ionization, ions move to satisfy the respective charge imbalance at the transport mechanism edge 136*b* and the back side Ra of the receiver member R. The polarity of the ions moving to the back side of the receiver member is the same as the polarity of the charge on the marking particles P adhering to the front side Rb of the receiver member R. As a result of the forces between like polarity charges (i.e., since like polarity charges repel), some of the marking particles (only one such particle shown in FIG. 2, and designated by the letter P') of the developed image on the receiver member are forced in the downstream direction on the receiver member causing artifact-inducing image disruptions.

The severity of the image disruption depends greatly on the surface and volume conductivity of the receiver member, the environmental conditions, and the speed of the receiver member/transport mechanism separation. At a certain level, the disruption becomes obvious enough to cause the reproduction to be unacceptable to the user. In order to reduce the image disruption effects of ionization at separation of a receiver member from the transport mechanism, a passive static eliminator carbon brush may be utilized, or coatings or static dissipative paints may be applied to the surfaces of the transport mechanism. However, passive solutions are not totally effective in that their level of efficiency is of a fixed predetermined value, and they do not account for the variability in the amount of ionization for which there must be some accommodation.

SUMMARY OF THE INVENTION

In view of the foregoing discussion, this invention is directed to a mechanism for substantially preventing image disruption effects of ionization in an electrostatographic reproduction apparatus having a dielectric member transported about a path in sequential operative relation with electrographic process stations. According to the operative relation, the moving dielectric member is uniformly charged, and thereafter the uniform charge on the dielectric member is selectively altered to form a latent image charge pattern thereon corresponding to information to be reproduced. The latent image charge pattern on the dielectric member is developed with triboelectrically charged pigmented marking particles. A receiver member is transported into operative association with a marking particle developed image on the dielectric member. An electrostatic charge is placed on the receiver member, such charge being of a polarity to induce transfer of a marking particle developed image from the dielectric member to the receiver member. The image bearing receiver member is transported along a path from the dielectric member to a fixing apparatus where a transferred developed marking particle image is fixed to the receiver member. A charger, located adjacent to the mechanism for transporting the image bearing receiver member, is for the purpose of placing a charge on a receiver member transported along the path from the dielectric member to the fixing apparatus. Such charge is of the opposite polarity as the charge applied to the receiver member to effect transfer of the developed marking particle image to such receiver member, whereby ionization induced image disruptions are substantially prevented.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
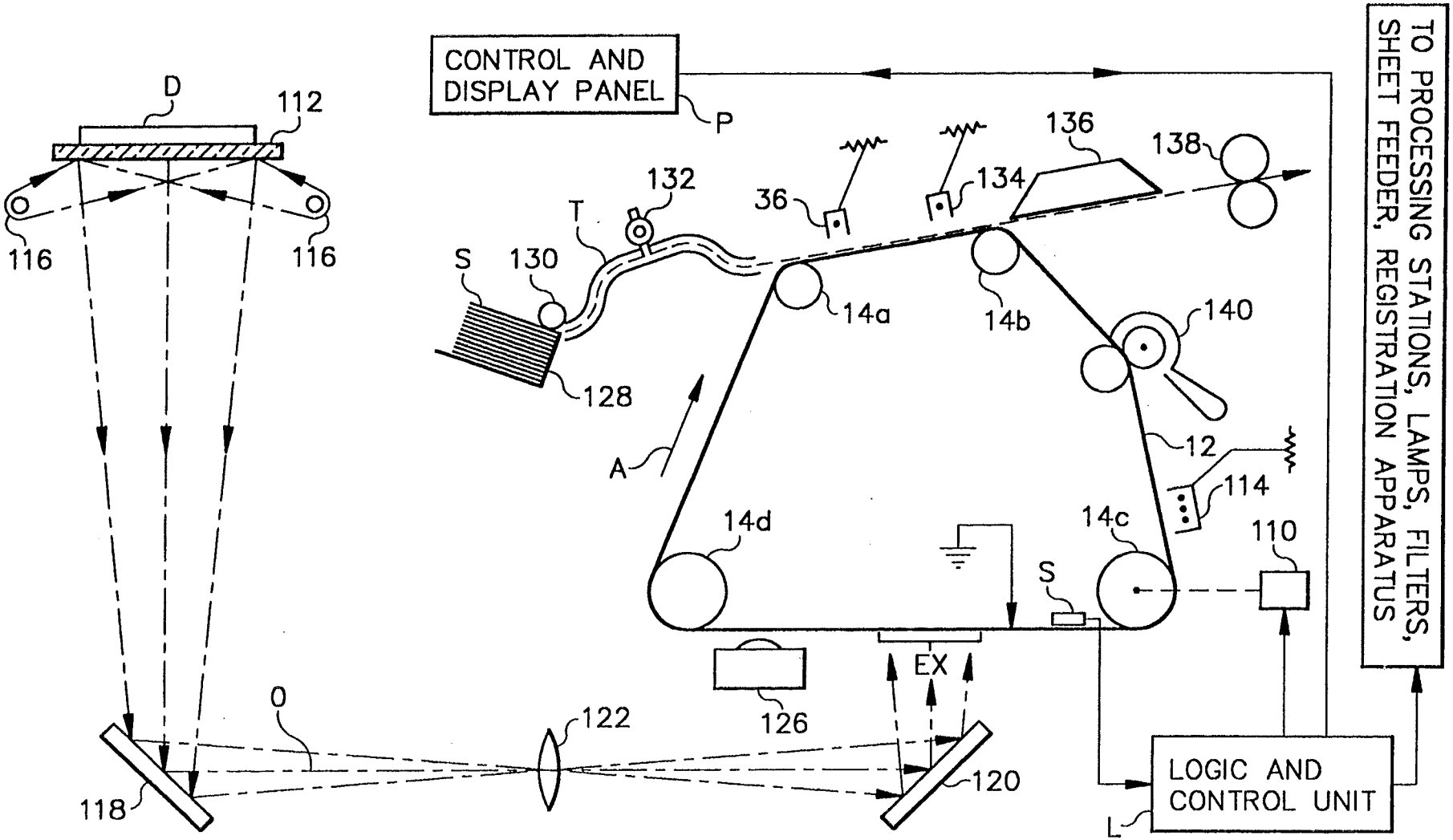
FIG. 1 is a schematic illustration of an exemplary electrostatographic reproduction apparatus including an active charger, according to this invention, for substantially preventing disruption of a marking particle image carried by a receiver member during transport of the receiver member by a transport mechanism between an image transfer station and a station wherein such image is fixed to such receiver member.

Referring now to the accompanying drawings, FIG. 1 shows schematically an exemplary electrostatographic reproduction apparatus designated generally by the numeral 10. The reproduction apparatus 10 includes a dielectric member (e.g., a grounded photoconductive web 12). The web 12, which has sequentially spaced image receiving areas, is for example of the type disclosed in U.S. Pat. No. 3,615,414 (issued Oct. 26, 1971, in the name of Light). Of course, it is within the scope of this invention that the dielectric member can take other forms, such as a photoconductive drum for example. The web 12 is supported by rollers 14*a*–14*d* for travel about a closed loop path. A motor 110 is operatively coupled to one of the rollers (e.g., roller 14*c*) to move the web about the closed loop path, in the direction of arrow A, through various electrographic processing stations under the control of a logic and control unit L.

The logic and control unit L includes, for example, a microprocessor based central processing unit receiving various input and timing signals. The input signal may be, for example, signals representative of the status of the various processing stations respectively, while the timing signals may be produced by a sensor S detecting movement of the web 12 about its closed loop path. Based on such signals and programs supplied by software control algorithms associated with the central processing unit, the logic and control unit L provides signals for controlling the operation of the various functions of the reproduction apparatus for carrying out the reproduction process. The production of suitable programs for commercially available central processing units is a conventional skill well understood in the art. The particular details of any such programs would, of course, depend upon the architecture of the designated central processing unit.

For the typical electrophotographic process carried out by the exemplary reproduction apparatus 10, the web 12 is moved by the motor 110 about the closed loop path. Following a particular image receiving area of the web, such area is brought into association with a primary charger 114 which places a uniform electrostatic charge on the web. As such area of the web 12 moves into association with an exposure station $E_x$, a document D (located information side down on a transparent platen 112) is illuminated by flash lamps 116 to generate a reflected light image of the information contained in the document. The reflected light image is directed along the optical path O to the exposure station $E_x$by a mirror and lens arrangement to expose the uniformly charged image receiving area of the web. Such exposure selectively alters the charge to form an electrostatic latent image charge pattern corresponding to the information contained in the document. Of course, the exposure could alternatively be accomplished by electronically produced images formed by LEDs (light emitting diodes) or fiber optic arrays, or by raster, laser or flying spot scanners directed onto the charged image receiving area of an appropriate dielectric member.

After exposure, the area of the web 12 bearing the latent image charge pattern moves into association with a development station 126. The development station 126 includes a magnetic brush developer mechanism containing pigmented marking particles which exhibit a triboelectric charge of opposite polarity to the electrostatic latent image charge pattern on the web 12. The developer mechanism brings the marking particles into association with the latent image charge pattern where the particles are attracted to the web to form a developed image thereon.

The developed image on the web 12 is then brought into association with a transfer station 36 including, for example, a corona transfer charger. Of course, this invention is suitable for utilization with other mechanisms for effecting transfer, such as an electrically biased transfer roller for example. As the area of the web bearing the developed image is moving toward the transfer station 36, a receiver member R is transported into association therewith. The reproduction apparatus 10 has at least one receiver member supply hopper 128 containing a stack of receiver members, such as cut sheets of plain bond paper or transparency material. A feed mechanism 130, such as an oscillating vacuum feeder, is located in juxtaposition with the hopper 128 so as to feed the topmost receiver member from the stack at a predetermined time into a transport path T intersecting the closed loop path of the web 12 immediately upstream of the transfer station 36. A registration apparatus 132 in the path T squares up a receiver member transported along the path relative to the path, and provides timing control over the receiver member so that the receiver member arrives at the web 12 in accurate register with the area of the web bearing the developed image.

The corona transfer charger of the transfer station 36 is connected to a DC or biased AC electrical potential source (not shown) to apply a charge to the receiver member as it travels with the image bearing area of the web 12 past the transfer station. The applied charge is of the opposite polarity as the charge on the marking particles and of substantially greater absolute value. Accordingly, the marking particles P forming the developed image are attracted to the receiver member R, line by line, from the web 12 and adhere to the receiver member in an image wise fashion as the receiver member and web travel past the corona transfer charger.

Downstream of the transfer station 36, an AC powered detack charger 134, if required, applies a charge to the receiver member to substantially neutralize the attractive charge holding the receiver member in contact with the web 12. Thus the receiver member can be separated from the web and transported by transport apparatus 136 to a fusing device 138 where the transferred marking particle image on the receiver member is fixed to the receiver member by, for example, heat and/or pressure. Thereafter, the receiver member is delivered to an output tray, or other well known finishing device (such as a stapler or sorter for example), for operator retrieval. As the receiver member is separated from the web 12, the web continues about its closed loop path into association with a cleaning apparatus 140 where any residual marking particles are removed. This particular area of the web is then returned to association with the primary charger 114 so that such area can be reused in forming another reproduction when desired.

Figure 2:
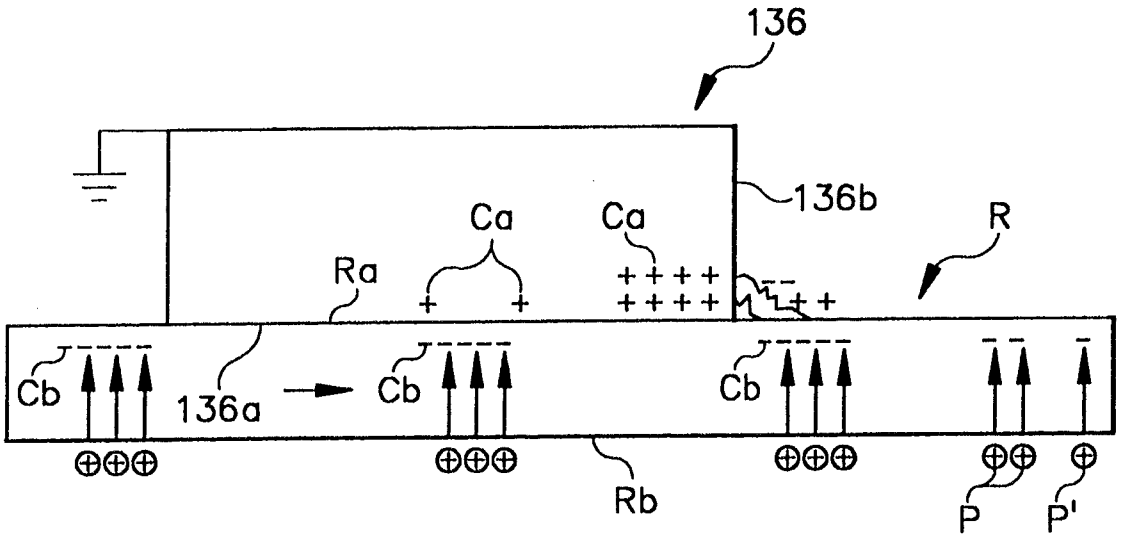
FIG. 2 (PRIOR ART)
FIG. 2 is a schematic illustration of a receiver member and its transport mechanism, as found in the prior art, depicting the electrostatic charge states which cause disruption of the marking particle image on the receiver member.

As discussed above, when the receiver member R is separated from the web 12 and is picked up by the transport apparatus 136, there has been in the past a tendency for charge to build up at the wall surface **136*b* where the receiver member leaves the transport apparatus (refer to FIG. 2). Such charge build up occurs because, in order to prevent any back transfer of the developed image marking particles, excess charge is provided on the back side of the receiver member. When the receiver member R is delivered to the fixing station 138 by the grounded transport mechanism 136, charges of opposite sign to the excess charge build up on the surface (136*a*) of the transport mechanism at the transport mechanism/receiver member interface. As the receiver member R moves along the surface 136*a*, the charges on such surface flow toward the downstream edge 136*b*** of the transport mechanism.

As pointed out above, due to the fact that the flowing surface charges cannot travel farther than the edge **136*b* of the transport mechanism, the charges collect at such edge. At the same time, due to the surface resistivity of the transported receiver member R, the charges on the back side Ra of the receiver member cannot move freely back along the receiver member in the direction toward the collection of opposite charge at the transport mechanism edge 136*b***. As a result, the transport mechanism surface charges and the receiver member charges separate, and the voltage therebetween increases until electrostatic breakdown (ionization) of the air occurs.

During such ionization, ions move to satisfy the respective charge imbalance at the transport mechanism edge **136*b* and the back side Ra of the receiver member R. The polarity of the ions moving to the back side of the receiver member is the same as the polarity of the charge on the marking particles P adhering to the front side Rb of the receiver member R. As a result of the forces between like polarity charges (i.e., since like polarity charges repel), some of the marking particles (one particle shown in FIG. 2**, and designated by the letter P') of the developed image on the receiver member are forced in the downstream direction on the receiver member causing artifact-inducing image disruptions. At a certain level, the disruption becomes obvious enough to cause the reproduction to be unacceptable to the user.

Figure 3:
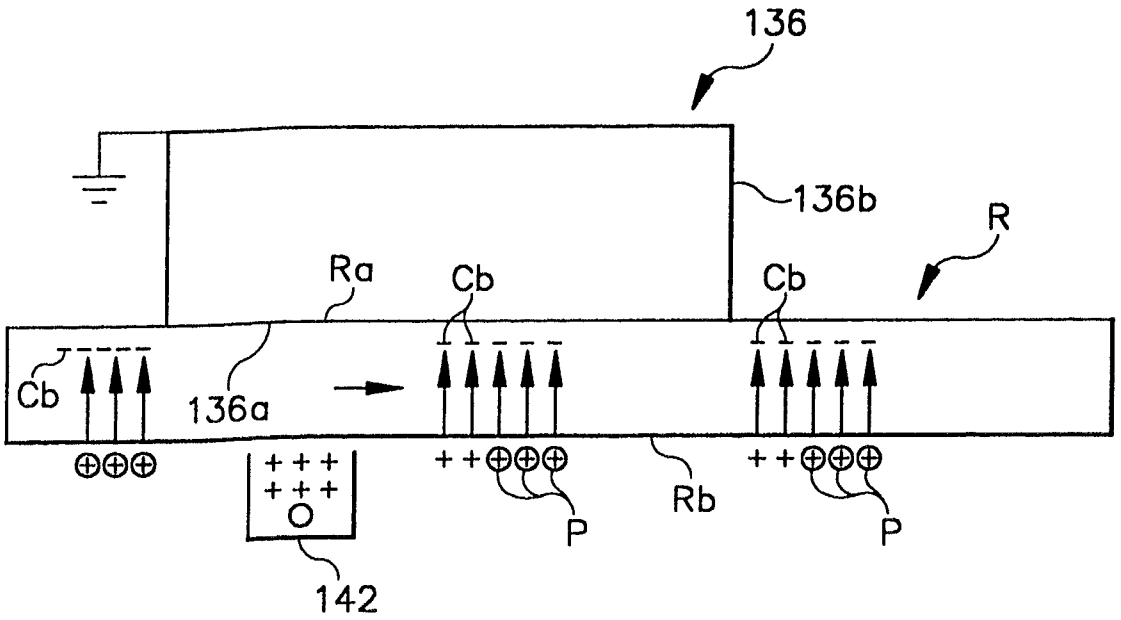
FIG. 3 is a schematic illustration of a receiver member and its transport mechanism, depicting the electrostatic charge states, and including an active charger, according to this invention, for substantially preventing disruption of the marking particle image on the receiver member.

In order to substantially eliminate the image disruption effects of ionization at separation of a receiver member from the transport mechanism, a charger 142 is located adjacent to the transport mechanism 136 (see FIG. 3). The charger 142 is, for example, of the single wire, constant current DC type. The charger 142, during operation, deposits a charge on a receiver member R as the receiver member is transported along the path from the web 12 to the fixing station 138. The deposited charge is selected to be of the opposite polarity as the transfer charge applied to the receiver member to effect transfer of the developed marking particle image to such receiver member. As such, the total or net charge in the receiver member is substantially zero so that there is no charge induced on the surface **136*a* of the transport mechanism 136. Accordingly, when the receiver member R separates from the transport mechanism 136**, there is no electrostatic field set up therebetween. Thus, there is no production of the described prior air ionization effect, and ionization induced image disruptions is prevented.

The invention has been described in detail with particular reference to preferred embodiment thereof, but it will be understood that variations and modifications can be effected within the spirit and scope of the invention as set forth in the claims.

What is claimed is:

1. An electrostatographic reproduction apparatus comprising: a dielectric member, means for transporting said dielectric member about a path in sequential operative relation with electrographic process stations; means for uniformly charging said moving dielectric member, means for selectively altering said uniform charge on said dielectric member to form a latent image charge pattern thereon corresponding to information to be reproduced; means for developing a latent image charge pattern on said dielectric member with triboelectrically charged pigmented marking particles; means for transporting a receiver member into operative association with a marking particle developed image on said dielectric member; means for placing an electrostatic charge on a receiver member of a polarity to induce transfer of a marking particle developed image from said dielectric member to said receiver member; means for fixing a transferred developed marking particle image to a receiver member; means for transporting an image bearing receiver member along a path from said dielectric member to said fixing means; and means, located adjacent to said image bearing receiver member transport means, for placing additional charge on the image bearing surface of a receiver member transported thereby, such charge being of the opposite polarity as the charge applied to said receiver member to effect transfer of the developed marking particle image to such receiver member.

2. The electrostatographic reproduction apparatus according to claim 1 wherein said means for placing a charge on a receiver member transported by said means for transporting an image bearing receiver member along a path from said dielectric member to said fixing means is a corona charger of the single wire, constant current DC type.

3. In an electrostatographic reproduction apparatus having a dielectric member, means for transporting said dielectric member about a path in sequential operative relation with electrographic process stations, means for uniformly charging said moving dielectric member, means for selectively altering said uniform charge on said dielectric member to form a latent image charge pattern thereon corresponding to information to be reproduced, means for developing a latent image charge pattern on said dielectric member with triboelectrically charged pigmented marking particles, means for transporting a receiver member into operative association with a marking particle developed image on said dielectric member, means for placing an electrostatic charge on a receiver member of a polarity to induce transfer of a marking particle developed image from said dielectric member to said receiver member, means for fixing a transferred developed marking particle image to a receiver member, means for transporting an image bearing receiver member along a path from said dielectric member to said fixing means, the improvement comprising:

means, located adjacent to said image bearing receiver member transport means, for placing additional charge on the image bearing surface of a receiver member transported thereby, such charge being of the opposite polarity as the charge applied to said receiver member to effect transfer of the developed marking particle image to such receiver member.

4. The electrostatographic reproduction apparatus according to claim 3 wherein said means for placing a charge on a receiver member transported by said means for transporting an image bearing receiver member along a path from said dielectric member to said fixing means is a corona charger of the single wire, constant current DC type.

5. The method for operating an electrostatographic reproduction apparatus having a dielectric member transported about a path in sequential operative relation with electrographic process stations in a manner to substantially prevent image disruption effects of ionization, said method comprising the steps of:

uniformly charging a moving dielectric member;

selectively altering the uniform charge on said dielectric member to form a latent image charge pattern thereon corresponding to information to be reproduced;

developing a latent image charge pattern on said dielectric member with triboelectrically charged pigmented marking particles;

transporting a receiver member into operative association with a marking particle developed image on said dielectric member;

placing an electrostatic charge on a receiver member of a polarity to induce transfer of a marking particle developed image from said dielectric member to said receiver member;

transporting an image bearing receiver member along a path from said dielectric member;

placing additional charge on the image bearing surface of a receiver member transported from said dielectric member along such path, such charge being of the opposite polarity as the charge applied to said receiver member to effect transfer of the developed marking particle image to such receiver member; and thereafter fixing a transferred developed marking particle image to a receiver member.

* * * * *